United States Patent [19]

Adler

[11] 4,405,106

[45] Sep. 20, 1983

[54] BABY BOTTLE HOLDER

[76] Inventor: Teri A. Adler, 6027 E. Calle del Norte, Scottsdale, Ariz. 85251

[21] Appl. No.: 385,022

[22] Filed: Jun. 4, 1982

[51] Int. Cl.[3] ..... A61J 9/06

[52] U.S. Cl. ..... 248/102; 248/104; 248/106

[58] Field of Search ..... 248/102, 103, 104, 105, 248/106, 107, 441.1, 447.4

[56] References Cited

U.S. PATENT DOCUMENTS

| | | | |
|---|---|---|---|
| 2,249,880 | 7/1941 | Browning | 248/107 |
| 2,526,121 | 10/1950 | Curry et al. | 248/102 |
| 2,693,334 | 11/1954 | Kacprzicki | 248/106 |
| 2,880,950 | 4/1959 | Williams et al. | 248/102 |

*Primary Examiner*—William E. Lyddane

*Assistant Examiner*—Sarah A. Lechok

*Attorney, Agent, or Firm*—Cahill, Sutton & Thomas

[57] ABSTRACT

A baby bottle holder includes a base for resting upon the chest of an infant, a bottle holding member hinged to the forwardmost edge of the base for extending upwardly and rearwardly therefrom, and a prop hinged to the rear end of the bottle holding member for engaging the base portion at one of a plurality of points disposed at varying distances from the forwardmost edge thereof to vary the angle at which the baby bottle is held. The bottle holding member includes a clamp for releasably engaging a conventionally-sized baby bottle. The base, bottle holding member and a prop are preferably formed as a single piece using a plastic molding or forming process to provide living hinges between the base and the bottle holding member and between the bottle holding member and the prop.

7 Claims, 7 Drawing Figures

FIG. 1
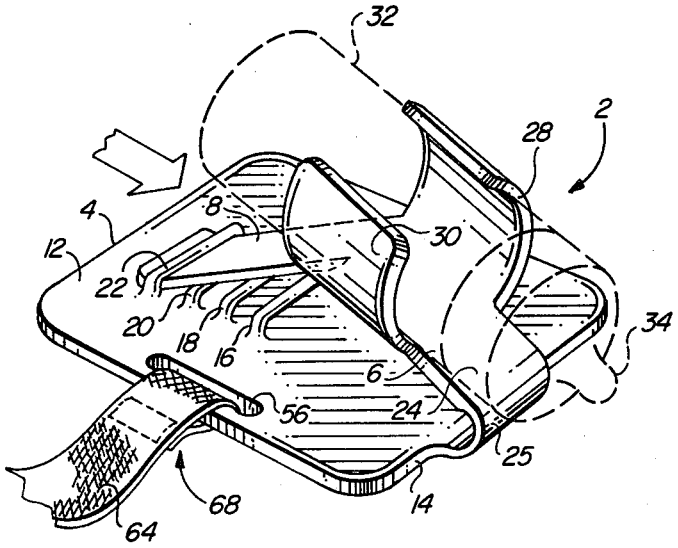
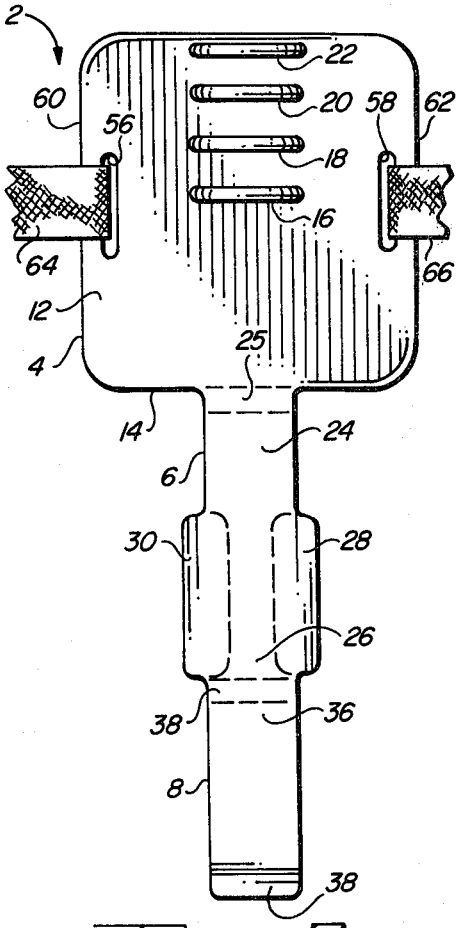
FIG. 2
FIG. 3
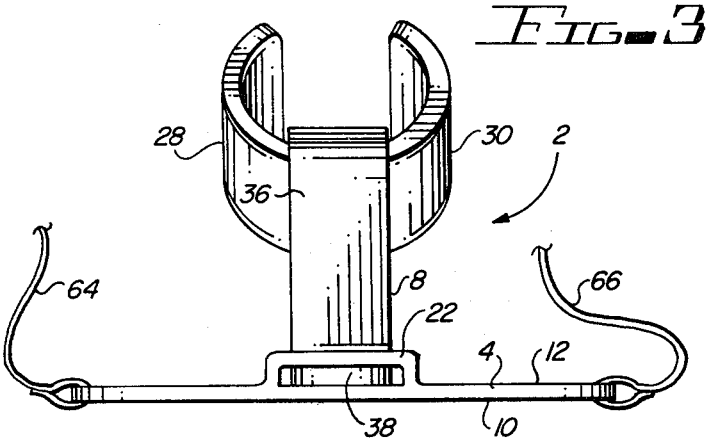
FIG. 4A
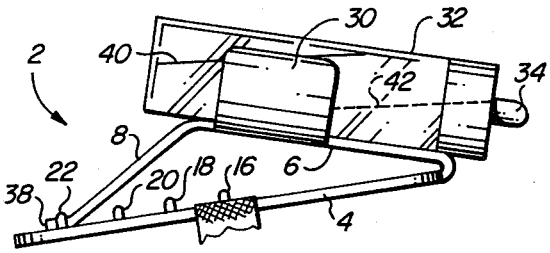
FIG. 4B
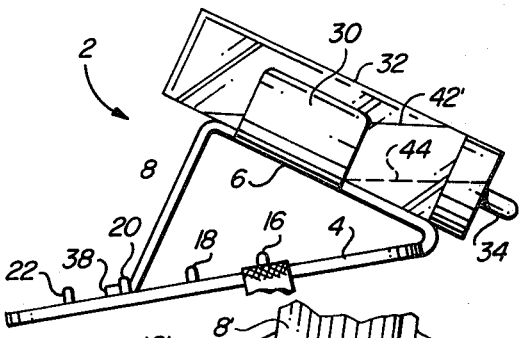
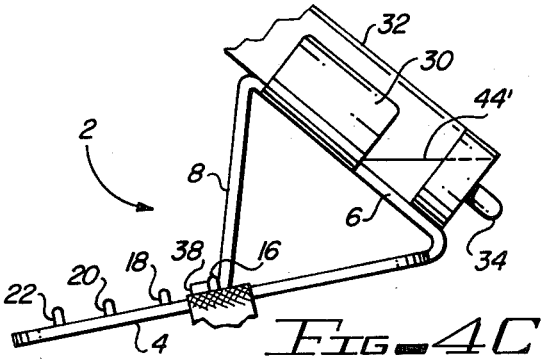
FIG. 4C
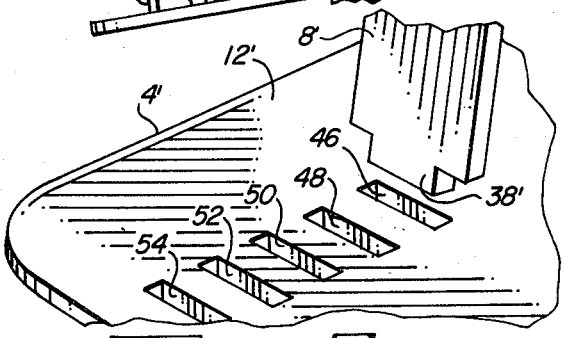
FIG. 5

BABY BOTTLE HOLDER

BACKGROUND OF THE INVENTION

1. Field of the Invention

The present invention relates generally to apparatus for holding a baby bottle in a feeding position to assist an infant during feedings, and more particulary, to a baby bottle holder having an improved and inexpensive construction while being adapted to limit the amount of liquid that the infant can consume during any given feeding interval.

2. Description of the Prior Art

Despite the relatively recent resurgence of breast feeding infants, many new mothers prefer or, in some instances, are compelled to rely upon bottle feedings to their infants for all or a portion of the infant's feedings. In some instances, the attending parent may be ill or handicapped and therefore unable to hold the infant and the baby bottle during feedings. Even when the attending parent is not ill or handicapped, it often happens that feeding periods are temporarily interrupted by telephone calls or various chores which need to be performed around the home. During such interruptions, or when the attending parent is temporarily preoccupied with another activity, the parent will frequently attempt to hold the child with one arm while using the other arm to hold a telephone or perform various other chores. In such instances, parents have been known to prop the bottle in a feeding position using a towel or diaper as a prop; even using such makeshift props, it is nonetheless difficult to steady the bottle from which the child is feeding, and typically results in an unpleasant feeding experience for the child.

Various types of devices for holding a baby bottle in a feeding position adjacent an infant's mouth are known in the prior art. For example, U.S. Pat. No. 2,510,953 discloses a nursing bottle holder having a panel and a cooperating flap for retaining a baby bottle; the panel is either snapped to the top of a cushioned pad or suspended from opposing sides of a crib by tapes. U.S. Pat. No. 2,880,950 discloses a nursing bottle holder having a base supported upon the chest of the infant; a bracket extends upwardly from the support base, and a bottle-gripping clamp is pivotally connected to the upper portion of the bracket. The pivotal connection between the bracket and the bottle-gripping clamp may be tightened to maintain the gripped bottle at a desired angle; alternatively, the pivotal connection may be loosened to allow the bottle to be either tilted back away from the infant or tilted forward to feed the infant. Finally, U.S. Pat. No. 3,117,759 discloses a bottle holder generally including a chest-encompassing base member and a bracket or standard secured to the base for supporting a bottle in a feeding position; the bracket or standard is adapted to swivel relative to the base for tracking side to side movement of the baby's head. Some of the various embodiments disclosed in this patent permit the angle at which the baby bottle is held to be varied in a vertical plane as, for example, through the use of a universal joint.

While each of the aforementioned prior art baby bottle holders serve to support a baby bottle in a feeding position for assisting an infant during feedings, each such prior art baby bottle holder is subject to one or more disadvantages not found within the present invention. For example, each such prior art baby bottle holder is of relatively complex construction, resulting in a correspondingly high manufacturing cost; none of such prior art baby bottle holders is readily adapted to be formed as an inexpensive one-piece, plastic product. Furthermore, some of the aforementioned prior art baby bottle holders would allow an infant, if temporarily left unattended or if the attention of the supervising parent is distracted for a period of time, to consume virtually the entire contents of the baby bottle during one continuous feeding interval; however, it is well known infants who consume large quantities of formula or other liquid without being burped to expell swallowed air during the feeding can suffer gastric difficulties. While some of the prior art baby bottle holders include a mechanism for adjusting the angle at which the baby bottle is held, and are hence capable of limiting the amount of fluid to be consumed by an infant, such baby bottle holders lack any mechanism for repeatedly and accurately varying the angle at which the baby bottle is held from among a plurality of selected, predetermined angles.

Accordingly, it is an object of the present invention to provide a baby bottle holder which is of simple construction and which may be inexpensively molded or formed as a single-piece, plastic product.

It is a further object of the present invention to provide such a baby bottle holder wherein the angle at which the baby bottle is held may be quickly and easily varied for controlling the amount of liquid that an infant can consume from the baby bottle during any given feeding interval.

It is still another object of the present invention to provide such a baby bottle holder wherein the angle at which the baby bottle is held can be selected accurately and repeatedly from among a plurality of predetermined positions.

These and other objects of the present invention will become more apparent to those skilled in the art as the description thereof proceeds.

SUMMARY OF THE INVENTION

Briefly described, and in accordance with one embodiment thereof, the present invention relates to a baby bottle holder including a base portion including a lower surface for resting upon the chest of an infant, and including a forwardmost edge normally disposed toward the infant's head; the base portion further includes an upper surface opposite the lower surface, the upper surface presenting a plurality of engagement points spaced at varying distances from the forwardmost edge of the base portion. The baby bottle holder further includes a bottle holding member having a front end hingedly coupled to the forwardmost edge of the base portion and including a clamp for releasably engaging a baby bottle. The hinged coupling between the front end of the bottle holding member and the base portion allows the bottle holding member to be pivoted with respect to the base portion for varying the angular position of the baby bottle engaged by the clamp. The bottle holding member further includes a rear end opposite the front end thereof, and the rear end of the bottle holding member is hingedly coupled to the upper end of a prop member. The prop member has a lower end opposite the upper end thereof and adapted to releasably engage one of the plurality of engagement points presented by the upper surface of the base portion. The plurality of engagement points are spaced at varying distances from the forwardmost edge of the base portion for selectively varying the position of the lower end of the prop member relative to the forwardmost edge of the base portion, thereby adjusting the angular position at which the baby bottle is held from among selected, predetermined angular positions.

The base portion of the baby bottle holder may be stabilized upon the chest of the infant by the extended fingers of one of the attending parent's hands. Alternatively, the baby bottle holder may include a fastener, such as an encircling strap secured to opposing sides of the base portion for stabilizing the base portion upon the infant's chest.

The base portion, bottle holding member, and prop member of the baby bottle holder are preferably formed or molded as a one-piece plastic structure from a relatively flexible plastic such as polyethylene or polypropylene. The process used to form or mold the one-piece structure creates so-called living hinges between the forwardmost edge of the base portion and the front end of the bottle holding member, and between the rear end of the bottle holding member and the upper end of the prop member, to effect hinged couplings therebetween.

BRIEF DESCRIPTION OF THE DRAWINGS

FIG. 1 is a perspective view of a baby bottle holder constructed in accordance with the teachings of the present invention and illustrating, in dashed lines, a baby bottle releasably engaged thereby.

FIG. 2 is a plan view of the baby bottle holder shown in FIG. 1 with the hinged couplings thereof shown in a fully extended position for illustrating the manner in which the baby bottle holder may be formed as a one-piece plastic structure.

FIG. 3 is a rear view of the baby bottle holder shown in FIG. 1 as seen from the position designated by the broadened arrow within FIG. 1.

FIGS. 4A–4C are side views of the baby bottle holder shown in FIG. 1 and showing the lower end of the prop member engaged by rear, intermediate, and front engagement points, respectively, presented by the base portion of the baby bottle holder for varying the angular position of the baby bottle.

FIG. 5 is a partial perspective view of the base portion and the lower end of the prop member for illustrating an alternate embodiment of the present invention.

DETAILED DESCRIPTION OF THE PREFERRED EMBODIMENTS

With reference to FIGS. 1–3, a baby bottle holder, designated generally by reference numeral 2, includes a base portion 4, a bottle holding member 6, and a prop member 8. Base portion 4 includes a lower surface 10 (see FIG. 3) for resting upon the chest of an infant, as well as an upper surface 12 opposite therefrom. Base portion 4 further includes a forwardmost edge 14 which is normally disposed toward the infant's head when baby bottle holder 2 is in use. Upper surface 12 presents a plurality of engagement points 16, 18, 20, 22 spaced at varying distances from forwardmost edge 14. Within the embodiment of the invention shown in FIGS. 1–3, engagement points 16–22 are in the form of raised loops. The function of engagement points 16–22 is described in further detail below.

Bottle holding member 6 includes a front end portion 24 and a rear end portion 26 (see FIG. 2) opposite thereto. Front end portion 24 is hingely coupled to forwardmost edge 14 of base portion 4 at the hinged coupling point designated by reference numeral 25. While hinged coupling 25 may be provided in any known manner, hinged coupling 25 is preferably formed as a so-called living hinge. Such a living hinge may be provided by a relatively thin strap of a flexible plastic material such as polyethylene or polypropylene, the ends of which strap are joined to the forwardmost edge 14 of base portion 4 and the front end 24 of bottle holding member 6.

A pair of clamping members 28 and 30 extend outwardly and upwardly from the parallel side edges of bottle holding member 6. As shown in FIG. 1, clamping members 28 and 30 each form a segment of a wall of a cylinder having an internal diameter commensurate with the diameter of a conventional baby bottle, outlined in FIG. 1 by dashed lines 32. Clamping members 28 and 30 are spaced apart from one another at their upper ends and are sufficiently resilient and flexible to be spread apart from one another for allowing baby bottle 32 to be inserted therebetween. Accordingly, clamping members 28 and 30 releasably engage baby bottle 32 and support it upon bottle holding member 6. As shown in FIG. 1, the nipple end 34 of baby bottle 32 is normally displaced adjacent hinged coupling 25 for being positioned proximate an infant's mouth. It will be appreciated that as bottle holding member 6 is pivoted about hinged coupling 25 relative to base portion 4, the angular position of baby bottle 32 is varied.

Still referring to FIGS. 1–3, prop member 8 includes an upper end 36 and a lower opposing end 38. Upper end 36 is joined to rear end 26 of bottle holding member 6 by hinged coupling 38. As described above with reference to hinged coupling 25, hinged coupling 38 is preferably formed by a relatively thin strap made of a flexible plastic material to provide a so-called living hinge. Lower end 38 of prop member 8 extends rearwardly at a slight angle from the central portion of prop member 8 to facilitate insertion thereof within each of the plurality of raised loops 16, 18, 20, 22 formed upon upper surface 12 of base portion 4. Lower end 38 of prop member 8 can releasably engage and bear against each of raised loops 16–22 and become interlocked therewith to position lower end 38 at a selected distance relative to forwardmost edge 14 of base portion 4 and to thereby adjust the angular position of bottle holding member 6, and hence, the angular orientation of baby bottle 32.

The manner in which baby bottle holder 2 is preferably used is shown in FIGS. 4A–4C. FIG. 4A shows the position of baby bottle holder 2 when baby bottle 32 is relatively full of liquid. In this event, lower end 38 of prop member 8 is inserted within the rearmost raised loop 22 for maintaining baby bottle 32 at a relatively acute angle with respect to base portion 4. Solid line 40 within baby bottle 32 designates the initial level of the liquid within baby bottle 32 when it is full. Preferably, the infant is held with his head raised and chest inclined somewhat upwardly, and hence base portion 4 is maintained at a slight upward incline toward forwardmost edge 14 while the infant is being fed, as shown in FIGS. 4A–4C; consequently, the infant may consume formula or other liquid within the baby bottle without interruption until the level of the liquid falls approximately to the level indicated by dashed line 42 in FIG. 4A, at which point nipple 34 is no longer supplied with liquid. At this time, the attending parent can remove baby bottle holder 2 from the chest of the infant and burp the infant to expell any excess air from the infant's stomach.

Referring now to FIG. 4B, a second feeding interval may then be commenced, at which time the attending parent disengages lower end 38 of prop member 8 from raised loop 22 and inserts it instead within the intermediate raised loop, for example, raised loop 20. Within FIG. 4B, the initial fluid level is designated by reference numeral 42', while the liquid level at which feeding is again terminated is designated by dashed line 44. When the liquid within baby bottle 32 falls to level 44, the attending parent may again burp the infant. If desired, a third feeding interval may be commenced to allow the infant to consume the remaining contents of baby bottle 32; in this event, lower end 38 of prop member 8 is disengaged from one of the intermediate raised loops and inserted within forwardmost raised loop 16, as shown in FIG. 4C, wherein line 44' designates the initial fluid level during the third feeding interval.

An alternate embodiment of the present invention is illustrated within FIG. 5 wherein primed reference numerals have been used to designate components corresponding to those described above with reference to the first embodiment of the present invention shown in FIGS. 1–3. Within FIG. 5, base portion 4' includes a series of slots or depressions 46, 48, 50, 52 and 54 extending downwardly from upper surface 12' thereof. Lower end 38' of prop member 8' is formed as a tab for releasably engaging and extending within each of slots 46–54 to vary the angular position of bottle holding member 6 and baby bottle 32.

The first embodiment of the present invention shown in FIGS. 1–3, and the second embodiment of the present invention shown in FIG. 5, are each preferably produced by a plastic forming or molding process whereby base portion 4, bottle holding member 6, and prop member 8 are formed as a one-piece, continuous plastic structure, as represented by FIG. 2. The entire structure is formed from a relatively flexible and resilient plastic, such as polyethylene or polypropylene, and hinged couplings 25 and 38 are provided by appropriately reducing the thickness of the plastic material at the locations corresponding to such hinged couplings to provide so-called living hinges. The one-piece plastic structure may be produced, for example, by thermoforming or injection molding the plastic stock material.

During useage of baby bottle holder 2, base portion 4 may be stabilized upon the infant's chest by the extended fingertips of the attending parent's hand being used to hold the infant. Alternatively, supplemental fastening means may be provided for stabilizing base portion 4 upon the infant's chest. Referring again to FIGS. 1–3, slotted apertures 56 and 58 may be provided within base portion 4 adjacent opposing side edges 60 and 62 thereof. A first strap 64 has one end thereof engaged with aperture 56, and a second strap 66 has one end thereof engaged with aperture 58. The manner of engaging the ends of straps 64 and 66 to the corresponding apertures within base portion 4 may simply result from looping the end of the strap through the appropriate aperture and underlapping the free end adjacent the strap for allowing the free end of the strap to be stitched or bonded thereto, as designated generally by reference numeral 68 within FIG. 1. The opposite ends (not shown) of straps 64 and 66 may be placed around the child's back and joined together by mating fastening surfaces, such as material sold under the federally registered trademark "VELCRO". Alternatively, the free ends of straps 64 and 66 may be joined together to form a single continuous strap made of an elastic material. Still other fastening means for stabilizing base portion 4 upon the infant's chest will be apparent to those skilled in the art; for example, lower surface 10 of base portion 4 could be provided with "VELCRO" fastening strips designed to mate with corresponding "VELCRO" fastening strips sewn to an article of clothing worn by the infant.

It should be noted that the present inventor does not advocate leaving an infant or child unattended during feeding periods, and the present invention should not be viewed as a means for eliminating the participation of an infant's parents during such feedings. To the contrary, the present invention contemplates that the present invention will be used only when the child is attended by a parent, both for purposes of safety and to develop a bond between infant and parent arising from physical closeness during feedings; the present invention is intended merely to assist the attending parent to maintain a baby bottle in a feeding position when the parent is not free to use both of his or her hands to hold the infant and steady the bottle, as when the parent is ill or handicapped.

Those skilled in the art will now appreciate that an improved baby bottle holder has been described which is of simple and inexpensive construction and which may be manufactured essentially as a single-piece, plastic product. The above described baby bottle holder allows the angle at which the baby bottle is held to be quicly and easily varied, thereby controlling the amount of liquid that an infant can consume from the baby bottle during any given feeding interval. Moreover, the various angular positions at which the baby bottle may be disposed can be selected accurately and repeatedly from among a plurality of predetermined positions in accordance with the engagement points presented by the base portion of the baby bottle holder.

While the present invention has been described with reference to preferred embodiments thereof, the description is for illustrative purposes only and is not to be construed as limiting the scope of the invention. Various modifications and changes may be made by those skilled in the art without departing from the true spirit and scope of the invention as defined by the appended claims.

I claim:

1. A baby bottle holder for assisting an infant during feedings and for limiting the amount of liquid that the infant can consume from a baby bottle during a feeding interval, said baby bottle holder comprising in combination:

a. a base portion including a lower surface for resting upon the chest of an infant, said base portion including a forwardmost edge normally disposed toward the infant's head, said base portion further including an upper surface opposite said lower surface, said upper surface presenting a plurality of engagement means spaced at varying distances from the forwardmost edge of said base portion;

b. a bottle holding member having front and rear ends and having a clamp disposed therebetween for releasably engaging a baby bottle, the front end of said bottle holding member being hingedly coupled to the forwardmost edge of said base portion for allowing said bottle holding member to be pivoted with respect to said base portion for varying the angular position of the baby bottle engaged by said clamp; and c. a prop member having upper and lower ends, the upper end of said prop member being hingedly coupled to said bottle holding member proximate the rear end thereof, and the lower end of said prop member being adapted to releasably engage one of said plurality of engagement means to selectively position the lower end of said prop member relative to the forwardmost edge of said base portion and to thereby adjust the angular position of the baby bottle engaged by said clamp.

2. A baby bottle holder as recited by claim 1 including fastening means for stabilizing said base portion upon the infant's chest.

3. A baby bottle holder as recited by claim 2 wherein said base portion includes first and second opposing sides and wherein said fastening means includes:

a. at least one strap having first and second ends, the first end of said strap being secured to the first side of said base portion, said strap being adapted to be extended around the back of the infant; and b. coupling means for coupling the second end of said strap to the second side of said base portion.

4. A baby bottle holder as recited by claim 1 wherein said base portion, said bottle holding member, and said prop member are formed as a one-piece, continuous plastic structure, and wherein the hinged coupling between said bottle holding member and said base portion and the hinged coupling between said prop member and said bottle holding member are each formed as living hinges.

5. A baby bottle holder as recited by claim 1 wherein said plurality of engagement means presented by said upper surface of said base portion comprise a plurality of depressions, and wherein the lower end of said prop member is adapted to be inserted within said plurality of depressions.

6. A baby bottle holder as recited by claim 1 wherein said plurality of engagement means presented by said upper surface comprises a plurality of raised members extending upwardly from said upper surface, and wherein the lower end of said prop member is adapted to engage and bear against said plurality of raised members.

7. A baby bottle holder as recited by claim 6 wherein said plurality of raised members comprise a plurality of raised loops, and wherein the lower end of said prop member is adapted to be inserted within and interlock with said plurality of raised loops.

* * * * *